US008015938B2

(12) United States Patent
Herre et al.

(10) Patent No.: US 8,015,938 B2
(45) Date of Patent: Sep. 13, 2011

(54) COATING ZONE AND COATING PLANT

(75) Inventors: Frank Herre, Oberriexingen (DE); Jürgen Haas, Knittlingen (DE); Michael Baumann, Flein (DE); Bekim Maxharraj, Bietigheim-Bissingen (DE); Nedime Maxharraj, legal representative, Bietigheim-Bissingen (DE); Marcus Frey, Weil der Stadt (DE); Hans Vetters, Pfaffenhofen (DE); Jan Grigoleit, Bietigheim-Bissingen (DE)

(73) Assignee: Duerr Systems Inc., Auburn Hills, MI (US)

( * ) Notice: Subject to any disclaimer, the term of this patent is extended or adjusted under 35 U.S.C. 154(b) by 1279 days.

(21) Appl. No.: 11/551,692

(22) Filed: Oct. 20, 2006

(65) Prior Publication Data

US 2008/0047486 A1 Feb. 28, 2008

Related U.S. Application Data

(60) Provisional application No. 60/729,261, filed on Oct. 21, 2005.

(51) Int. Cl.
*B05C 11/00* (2006.01)

(52) U.S. Cl. ..... 118/75; 118/313; 118/300; 118/323; 362/253; 362/234; 362/147; 454/52

(58) Field of Classification Search ..... 118/313, 118/300, 323; 362/253, 234, 147; 454/52
See application file for complete search history.

(56) References Cited

U.S. PATENT DOCUMENTS

| | | | | |
|---|---|---|---|---|
| 2,445,074 | A * | 7/1948 | McCue | 454/51 |
| 3,170,384 | A * | 2/1965 | Krantz et al. | 454/54 |
| 3,391,630 | A * | 7/1968 | Wilhelmsson | 454/52 |
| 4,222,319 | A * | 9/1980 | Donahue | 454/52 |
| 2004/0107900 | A1 * | 6/2004 | Clifford et al. | 118/305 |

FOREIGN PATENT DOCUMENTS

| | | | |
|---|---|---|---|
| DE | 20313854 | U1 * | 11/2003 |
| DE | 20313854 | U1 | 11/2003 |
| DE | 102005036767 | A1 | 2/2007 |
| FR | 2806012 | A | 9/2001 |
| FR | 2806012 | A1 * | 9/2001 |
| WO | WO2004037430 | A | 5/2007 |

OTHER PUBLICATIONS

Machine Translation of FR 2806012A1.*
Machine translation of EP 1512466.*
English language abstract for DE20313854.
EP 1 749 584 A1 with Search Report Dated Nov. 9, 2006.

* cited by examiner

*Primary Examiner* — Dah-Wei D Yuan
*Assistant Examiner* — Albert Hilton
(74) *Attorney, Agent, or Firm* — Rader Fishman & Grauer

(57) ABSTRACT

Coating zones having guide elevated rails for coating and/or handling robots are disclosed. The coating zones may include walk-in control areas positioned one above the other on the outside of the side walls. In the upper control area, in which control and supply devices for robots on elevated guide rails may be provided, the side wall may generally slant inward. Load-bearing structures for the elevated guide rails may be braced by supporting members extending generally perpendicular to the line of conveyance of the application objects on or under the floor level or at the ceiling.

17 Claims, 4 Drawing Sheets

COATING ZONE AND COATING PLANT

CROSS-REFERENCE TO RELATED APPLICATIONS

This application claims benefit of U.S. Provisional Patent Application Ser. No. 60/729,261 filed on Oct. 21, 2005, which is incorporated by reference herein in its entirety.

FIELD OF THE INVENTION

The invention relates to a zone of a coating installation and a coating installation having such coating zones. In particular it deals with painting zones or other zones of an installation for the production coating of application objects, such as vehicle bodies or their add-on parts using robots, including painting or other application robots, other manipulators, for example for additional equipment and/or handling robots, such as door or hood openers.

BACKGROUND

In conventional paint booths for vehicle bodies using robots, the guide rails are usually installed laterally on the booth floor. For different reasons, the arrangement of robot guide rails above the conveyor or even above the bodies may be more expedient, for example because they obstruct the view through the side wall of the booth and provide less access to the bodies or other application objects and/or because the higher placed robots have correspondingly improved freedom of movement, and/or because the higher placed guide rails are contaminated less by overspray which is drawn off downward by the normal airflow in the booth. Further, higher mounted robots may have the advantage that they disturb the airflow moving from the booth ceiling downward along the body sides on to the booth floor less than robots positioned on the floor next to the body, which restrict the air passage directly at the body, possibly resulting in an undesirable increase in airflow velocity.

In the case of a painting installation known from WO 2004/037430 A1, several painting robots are located on two parallel guide rails which, in turn, are mounted on a box frame positioned inside the booth having four legs connected by cross braces, in a manner similar to the known gantry robot designs.

A painting zone in a paint booth for vehicle bodies with air supply through the upper ceiling and two walk-in control areas positioned vertically one above the other is known from EP 1 263 535 B1, wherein robot guide rails raised above the conveyor are built into modular pre-assembled side wall elements of the booth. The load-bearing structures of the guide rails, in contrast to the box frame from WO 2004/037430 A1, are separated from each other in the booth interior, thus avoiding the cross-braces in the booth interior and potential problems concerning the mechanical stability of the known box frame. On the floor of this known paint booth, which is configured as usual as a grating to draw off the vertical flow of air, additional guide rails for more robots are mounted below the elevated guide rails next to the lower control area, with the robots on the lower level being painting robots, the upper robots being door or hood openers.

Paint booths for vehicle bodies having robot guide rails mounted vertically one above the other on the booth walls and with several painting zones located one after the other along the conveyor track are known from EP 0 745 429 A1.

In the case of the known paint zones have elevated robot guide rails, the side walls of the paint booth run from their upper ceiling vertically down to floor level. Since the paint booth, including the walk-in control areas, must not be too wide in view of the construction and investment cost, this results in major disadvantages for the known paint zones. Firstly, the space available for the control areas is inconveniently narrow. Secondly, if the control areas were enlarged for a given total width, the passages for the air flowing downward into the booth from the ceiling would be unacceptably restricted.

Another problem is the support required for the high-mounted guide rails, which by its nature is more difficult to achieve than in the case of guide rails on the booth floor. Adequate stability for guide rails mounted above the conveyor on a booth wall, especially without separate cross members at the height of these guide rails, was achieved until now only with undesirably high construction expense for correspondingly stable side walls.

SUMMARY

It would be desirable to create a coating or other zone for a coating installation, or an installation having several such zones which are distinguished by good space utilization with the best possible airflow and low construction cost.

In accordance with a first aspect of the invention, a coating zone has an upper walk-in control area on one side, or preferably on both sides, of the conveyor track at the height of elevated robot guide rails which is separated from the interior of the coating zone by slanting side walls, whereby the interior in this area becomes progressively narrower towards the top. As a consequence, a correspondingly wider area for the walk-in control area is created on the outside of the slanting side walls which can be used both for the control equipment for the robot or robots located on the elevated guide rail and for the personnel observing the coating process, and maintenance operations. A considerable advantage of arranging the control equipment in the proximity of the robots is the correspondingly short hose and line connections.

At the same time, as a result of the slanting side walls, the flow cross-section of the coating zone available for airflow increases towards the bottom, whereby the obstruction of the airflow by the robots can be compensated to a corresponding degree and the flow velocities inside the coating zone change less radically than with walls that are vertical from top to bottom. Airflow at the bodies or other application objects that is too strong would reduce transfer efficiency, for example, by entraining the coating material that is to be applied.

Preferably the side walls have a slanting shape only in the upper walk-in control area, while in the lower walk-in control area, that is at the (typically grating-like) floor of the coating zone, they preferably run vertically upward to above the upper edge of the application objects, for example up to the upper control area. This avoids undesirably large overall width for the coating zone in the floor area.

If only one elevated robot guide rail is available, preferably on both sides of the conveyor, the lower walk-in control area on at least one side of the conveyor can be used, as an example, to observe the coating process without the view being obstructed by robots and for maintenance work, etc. It is similarly possible to install additional rails for more robots on the floor of the coating zone, or in the proximity of the floor level on the side wall of the coating zone on one side, or preferably on both sides, of the conveyor. The guide rails can be positioned one above the other on each side of the coating zone at a distance from each other such that the individual robots can pass each other in the longitudinal direction. More than two guide rails can also be provided on one or each side, specifically at different heights separated vertically from each other on three or more planes. Possibilities exist in each case for the distribution of several robots on the guide rails, including painting and handling robots, in particular those described in DE 10 2004 030858 and DE 10 2004 056493, (EP 1 609 532 A1), the complete content of which is incorporated by reference in the disclosure of the present application. It is further possible to install one or several guide rail arrays located spaced apart one above the other on one or both sides of the coating zone and the conveyor which may contain more than just one rail and are so designed that moveable robots can pass each other in the direction parallel to the conveyor track on the different, spatially offset rails of one and the same guide rail array.

The rails mentioned in conjunction with the present application can advantageously also be used for robots for additional equipment which are moveable on these rails which can be present in addition to application robots with atomizers (applicators) and/or handling robots (handlers). Examples of additional equipment are any type of handling equipment, including mobile driers which can irradiate the application objects for drying in a known way with IR or UV radiation, as well as cleaning equipment and particularly probes and measuring equipment, such as are already known and customary for measuring coating results and film quality characteristics such as film build, wave scan, color, gloss, brightness, etc. and for identifying coating defects. The measurements can be made online and for online quality measurement with automatic defect correction on subsequent application objects as required, for example in accordance with EP 0 874 213 B1 or EP 1 176 388 A2. The additional equipment can be located in a coating booth or in a separate repair or check zone, wherein they can be positioned on the guide rails mentioned without application robots or door openers or the like. The pieces of additional equipment can expediently be mounted on separate robots or, with the aid of interchangeable heads, also on robots serving as universal carriers for different equipment, such as for example atomizers, driers, measuring systems, etc. If the additional equipment is located in the coating zone, it can be moveable on the rails for the application and/or handling robots installed there, or instead, on separate rails which can be offset in height from the rails for the application or handling robots.

The term "robot" used here is to be understood generally in the meaning of a freely programmable multi-axis automat, preferably of articulated construction with at least six axes of rotation (three main axes and three wrist axes), where the base for the sequential axes of motion can be moveable as a sled on one of the rails under consideration here, similar to the track (axis 7) of conventional painting robots or the like. It is also possible to mount at least two robot structures on a common base moveable as a sled on one and the same rail, each having, for example, two or three primary axes which can have the same or different functions depending on the application (coating, handling, measuring, etc), similar to robots moveable individually on the same or separate rails.

As was already mentioned at the beginning, special load-bearing structures are required for the installation of the guide rails located above the conveyor, and if expedient, above the upper edges of the bodies or other application objects for several robots working next to each other as the case may be. These structures were previously implemented either by frame structures placed in the coating zone or by suitable configuration of the side walls themselves. In contrast, in accordance with a further aspect of the invention, load-bearing structures located on at least one and preferably both side walls of the coating zone are provided and preferably rigidly connected to them, which structures can be braced with supporting members extending perpendicular to the path of the conveyor, for example, on or below the floor of the zone or at the ceiling, so that the side walls themselves do not have to assume any load-bearing function and can be correspondingly simple in configuration and to a large extent transparent in the lower area, for example for observing the coating process. These supporting members do not have to be part of the actual side wall, but can distanced from the side wall and/or extend away from the side wall perpendicular to the line of conveyance (preferably in a parallel direction to the floor level.

On the other hand, the load-bearing structures (in contrast to the cross-braces of the gantry design in accordance with the previously mentioned WO 2004/037430) preferably have no supporting members which extend above the top side of the application objects, such as vehicle bodies, but extend through the interior of the coating zone below the ceiling and disturb the vertical airflow in the booth and/or could contaminate the application objects with paint or other particles which adhere to them and then become detached.

It can be particularly expedient, if these load-bearing structures are combined structurally with the load-bearing or reinforcing members of the dividing walls ("silhouettes") which are required and normal at the entry and/or exit ends of the individual coating zones. The purpose of these dividing walls positioned perpendicular to the conveyor track can be, for example, to isolate from each several coating zones positioned one after the other in a paint booth each having different air management, perhaps a zone for electrostatic application with rotary atomizers from a zone for air atomizers in which different air speeds are required, when mixing of air and cross-currents between the zones must be prevented as much as possible. The transverse walls have an additional safety function for personnel protection.

One possibility, for example, is to attach these dividing walls positioned perpendicular to the conveyor track directly to the load-bearing structures of the elevated robot guide rails, thereby eliminating the expense for separate attachments for the dividing walls. In particular, a reinforcing structure for the dividing walls can also act as a load-bearing or supporting structure for the robot guide rails. The load-bearing or supporting structures for the rails can be an integral part of a reinforcement for the dividing walls, or conversely the reinforcements for the dividing walls can be an integral part of the load-bearing or supporting structures for the guide rails.

The application objects can be transported through the coating zones under consideration in continuous flow operation, with robots usually traveling along the conveyor track, or instead in cycled operation in which the object stops while it is being treated.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 3:
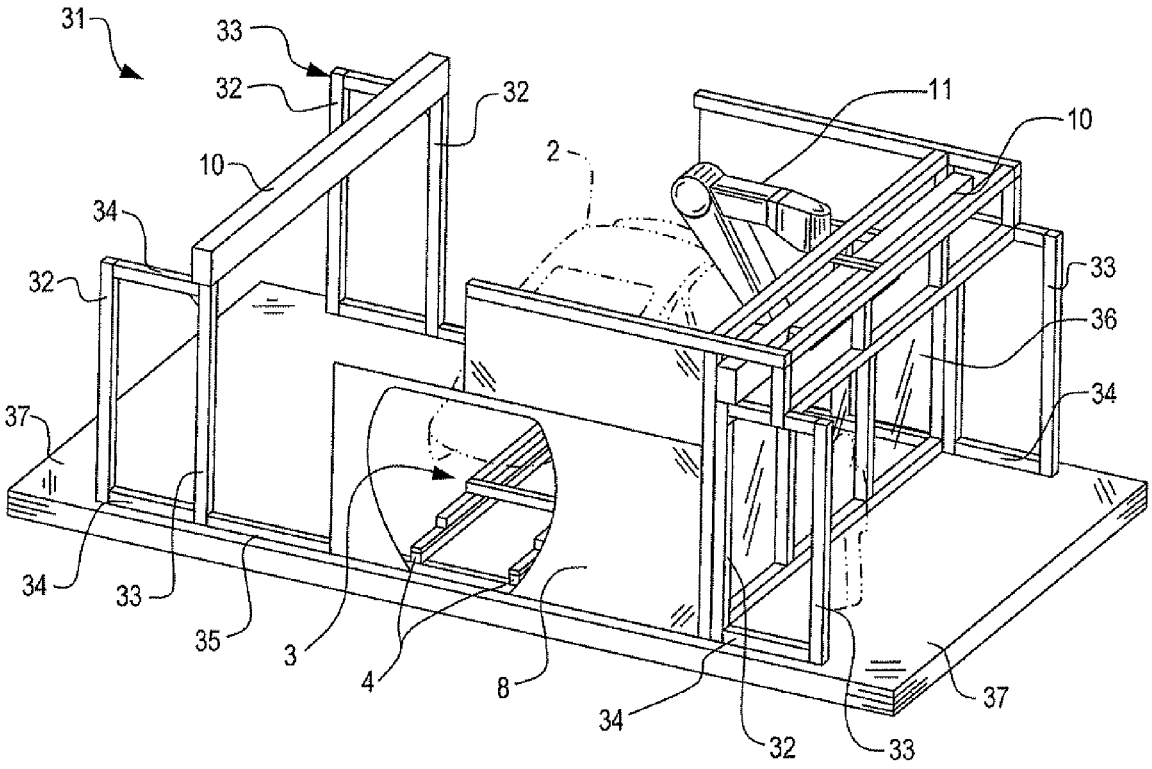
FIG. 3 shows a coating in accordance with a third embodiment.

The same reference numbers are used in what follows for identical or matching elements and for the different embodiments. The coating zone 1 shown in FIG. 1 for vehicle bodies 2 can form part of a paint booth. The painting zones shown and described here in what follows can possibly also be located within a wider booth. The bodies can be moved through the coating zone 1 on a conventional floor conveyor 3 (refer to FIG. 3, not shown in FIG. 1) along a line of conveyance defined, for example, by rails 4 (FIG. 3). The coating zone is bounded above by a horizontal ceiling 5, on both sides by side walls 6 or 6' positioned parallel to the line of conveyance, below by the horizontal floor 7 and at the entry and/or exit ends by perpendicular dividing walls 8 or 38 positioned perpendicular to the line of conveyance. As an example, additional similar or different coating zones can follow in the same paint booth on the outsides of the dividing walls 8 and/or 8' along the line of conveyance. In the normal way in operation, a substantially vertically downward oriented airflow is brought through the coating zone 1 which can be introduced through the ceiling provided for this purpose with passages or with a separate ventilation system and can exit through the floor 7 which can be configured as a grating. The dividing walls 8 or 8' are embedded to seal tightly between the wall elements surrounding them, in particular the side walls 6 and 6' and if possible also tightly between the ceiling 5 and the floor 7 to prevent air mixing or cross-currents, in particular between adjacent zones with different air management on the two sides of the particular dividing wall 8 or 8'. Openings 9 in the dividing walls 8 or 8' for the bodies 2 on the conveyor 3 can be closed during coating for this reason. Further, closable doors (not shown) for the operating personnel can be located in the side walls 6 and 6' and/or dividing walls 8 or 8', for example, preferably of metal frame construction on one or both sides of the dividing wall 8, as is shown at 43 in the embodiment from FIG. 4 described further below. This provides advantages with respect to safety such as access protection while simultaneously creating escape routes.

As shown in the drawing, guide rail arrays 10 or 10' for robots 11 are located on the side walls in the interior of the coating zone 1, for example, about half way up the side walls 6 and 6' and preferably above the top sides of the bodies 2. The robots 11 can be equipped with the usual atomizers or other applicators for coating material. In the example shown, the load-bearing structure for the guide rails is provided by hanging vertical supports 12 which are anchored in or at the ceiling 5 to support members 14 lying horizontally perpendicular to the transport path and in turn carry the guide rails 10 or 10' using lower support members 14 similarly lying horizontally perpendicular. The supports 12 are located on the side of the area of the coating zone 1 and the specific side wall 6 or 6'. The ceiling 5 can in this example be a part of the ceiling construction, possibly consisting of concrete, of a larger space in which the coating zone 1 is installed.

The dividing walls 8 or 8' are solidly connected to at least the side walls 6 and 6' and their frame can also be attached directly 19 to the load-bearing structures for the guide rail arrays 10 or 10'.

On the side of the side walls 6 and 6' facing away from its interior, the coating zone 1 has a first walk-in control area 15 or 15' for the operating personnel 16 on the floor 7, which continues to this point. Further, preferably on both sides of the coating zone 1 above the first control area 16 or 16' on the upper side of the structures containing the guide rail arrays 10 or 10', also on the outside of the side walls 6 or 6', there is a second walk-in control area 17 or 17' for the operating personnel 16. Control panels (not shown) and other control and supply devices for the robots 11 can be located at least in the upper control area 17 and 17'.

In the example shown, the coating zone 1 contains only the elevated robot guide rail arrays 10 and 10', but the potential exists for installing another guide rail for additional robots on the floor 7 between the bodies 2 and the side walls 6 or 6' on one or both sides parallel to the guide rails of the arrays 10 and 10'.

As shown in the drawing, the side walls 6 and 6' in the lower control area 15 or 15' run vertically upward from the floor 7 as far as the structures containing the guide rail arrays 10 and 10' and thus, in the example shown, up to a height above the bodies 2. On the other hand, the section 18 of the side walls 6 and 6' at the upper walk-in control area 17 or 17' running upward from the robot guide rails, as shown in the drawing, is slanted inward at an angle so that the interior of the coating zone 1 narrows constantly in these control areas. The slanting shape of the side walls 6 and 6' can, as shown in the drawing, change to a vertical section again before reaching the ceiling 5, but which is shorter in the vertical direction than the slanting section 18. The air inlet openings for the coating zone are located in the area of the ceiling 5 lying between the upper end of the side walls 6 and 6'

The vertical lower parts of the side walls 6 and/or 6' can, for example, be high enough (approx. 2 meters) so that doors can be built in for the operating personnel 16.

The side walls 6 and 6' themselves do not have to have a load-bearing function for other components of the coating zone and can consist at least for the most part of transparent material such as glass to allow personnel 16 to view the interior. The dividing walls 8 and 8' can also be transparent.

In the case of the only schematically shown floor 7, it can be a sub- or load-bearing construction carried for its part on separate supports(not shown) in or under which electrical, pneumatic and supply line arrays for the zone under consideration can run, including the circulation lines for color supply in the case of a paint booth. Trap doors can be provided in the floor 7, for example, for access to this supply area.

Modular construction of the zones described here can be particularly expedient. They can also be completely or at least partially pre-assembled at the installation manufacturer and transported in this state to the installation operator, providing the advantages explained in EP 0 349 177A among others. When retrofitting existing older installations, such preferably pre-assembled modules can be set on existing foundations as a floor with the assistance of the abovementioned sub-or load-bearing structures.

Figure 1:
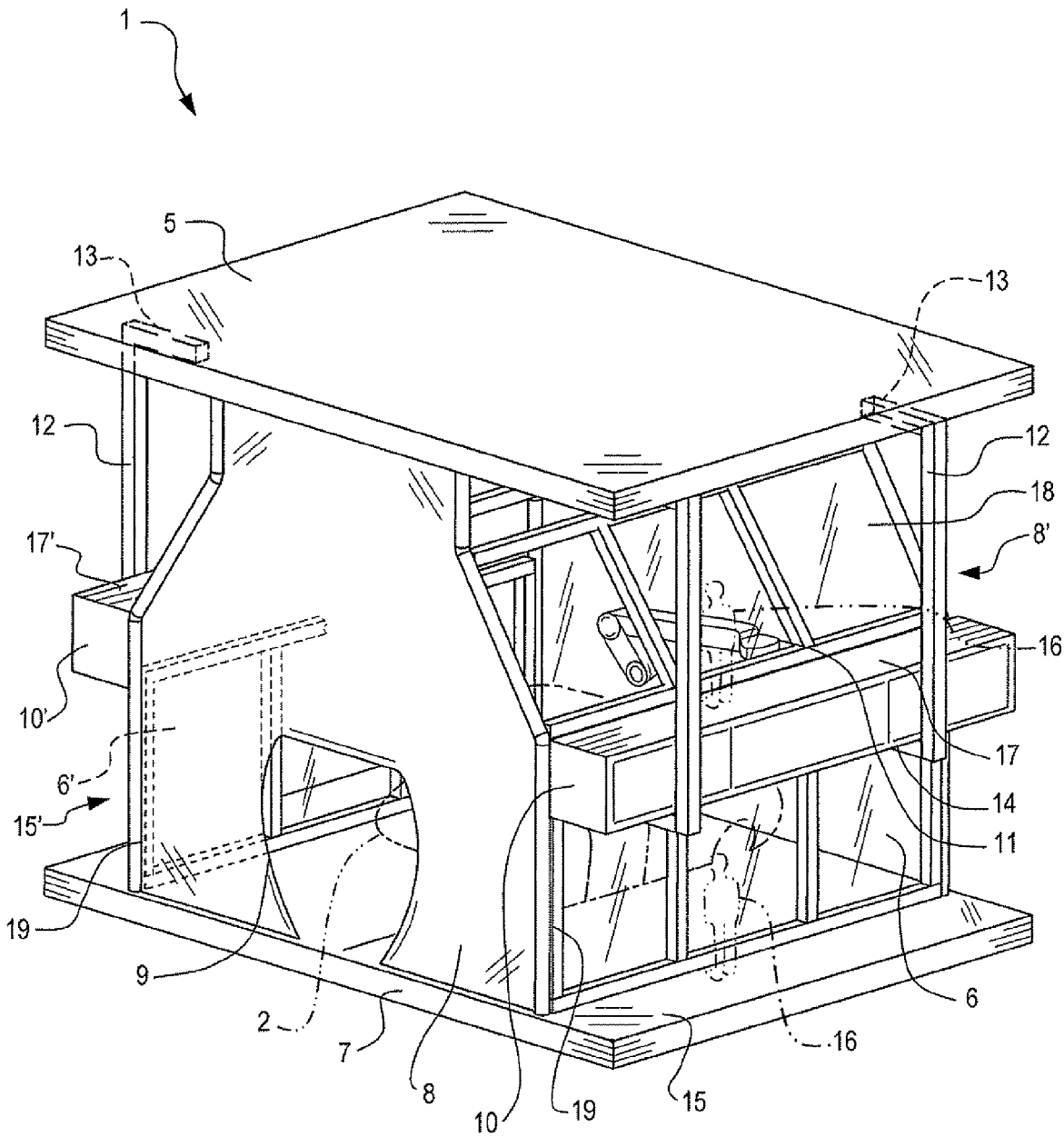
FIG. 1 shows a coating zone in accordance with a first embodiment of the invention.
Figure 2:
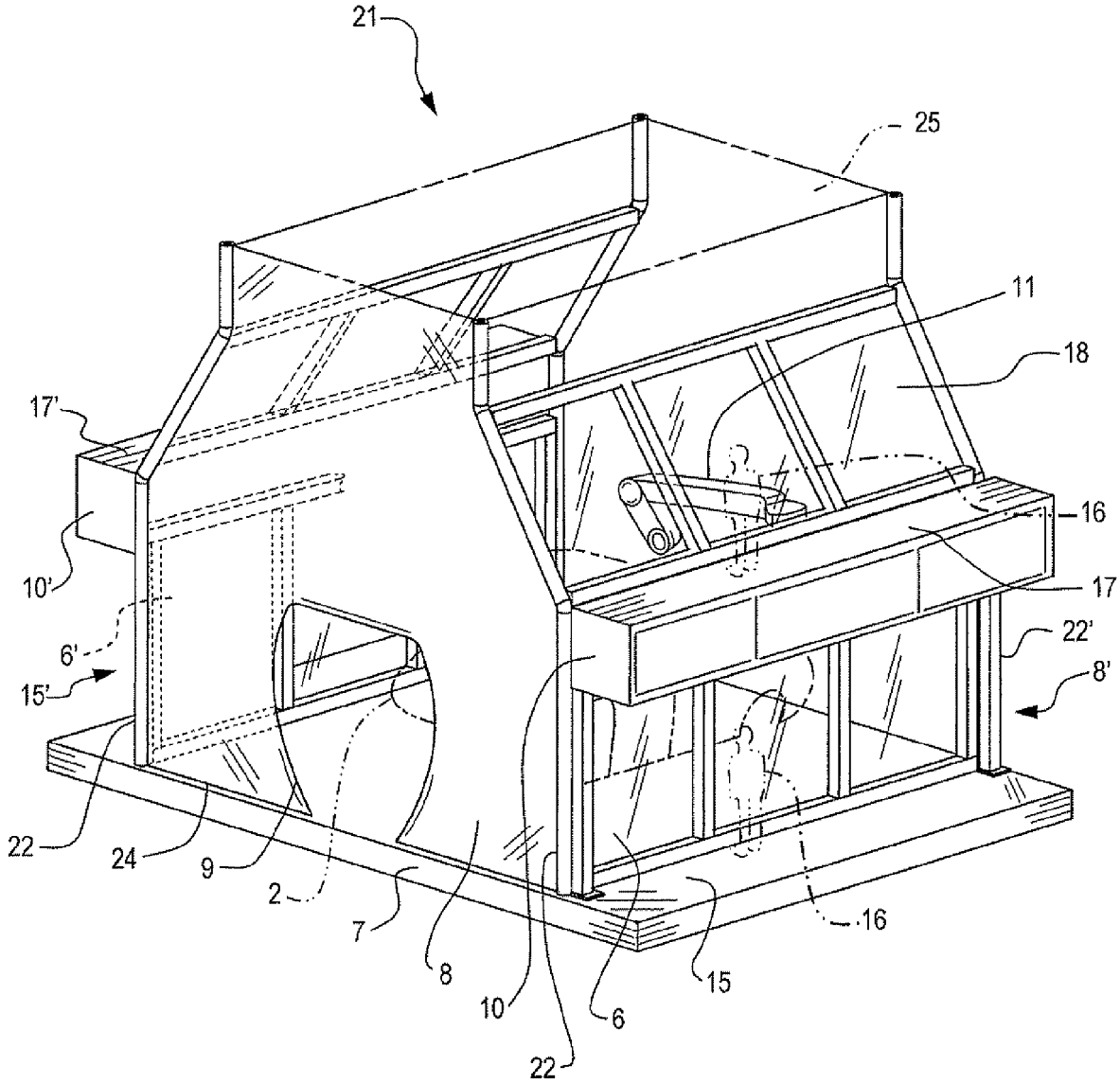
FIG. 2 shows a second embodiment of the invention.

The coating zone 21 from FIG. 2 is largely identical to the embodiment from FIG. 1 so that it is superfluous to repeat the description regarding the guide rail arrays 10 with the robots 11, the side walls 6 with the slanting sections 18, the control areas 15 and 17 and the dividing walls 8. The guide rails here are not suspended from a stable ceiling, as in FIG. 1, but installed on vertical load-bearing supports 22. The load-bearing supports, for their part, can be braced by transverse support members indicated only schematically at 24 on the floor 7, which is assumed here to be stable. Suitable transverse support members can also be located under the floor 7, The air-permeable ceiling 25 of the coating zone 21 can be configured as with conventional paint booths.

The coating zone 31 shown in FIG. 3 can be the same as the embodiments described previously with regard to the walk-in control zones and the partially slanting side walls, although this is not shown here. The structure from FIG. 3 is also suitable for a coating zone without these features. There is congruence at least with FIG. 1 and FIG. 2 with respect to the guide rail arrays 10 for robots 11 located above the conveyor 3 and, where required, above the bodies 2. The conveyor 3 shown in FIG. 3 with the rails 4 for the bodies 2 can also be used in the embodiments from FIG. 1 and FIG. 2.

The load-bearing structures for the elevated guide rail arrays 10 in particular are configured differently than in the embodiments described previously. These load-bearing structures consist substantially of frame constructions 33 of the rectilinear shape shown, with two vertical load-bearing pillars 32 connected by upper and lower transverse support members 34. The frame constructions 33 in this example stand in a plane lying vertically perpendicular to the conveyor rails 4 on the side of the guide rail arrays 10 of the robots 11 facing away from the conveyor 3 and thus on the outside of the side walls 36 on a part of the floor 37. As shown in the drawing, a frame of this kind can be positioned under each of the ends of the guide rails arrays 10 bordering the outside of the vertical sidewall 36 at this point which is braced on the part of the floor 37 with the transverse support member 34 and carries the guide-rail array 10 on its transverse support member. Additional similar frames or other braces (not shown) can also be in place. The two frame constructions 33 acting as load-bearing structures for the robot guide rails at the entry and exit ends of the coating zone 31 can preferably be connected in the vicinity of the floor level and expediently be connected below the conveyor 3 by a cross-brace 35. Similar cross-braces for the frame construction 33 can also be located at the level of the guide rail arrays 10.

The dividing walls 8 located at the entry and/or exit ends of the coating zone 31 can be expediently embedded between the parallel frame structures 33 bordering them which, in addition to their function as a load-bearing structure for the robot guide rails, can simultaneously act as a reinforcing or frame assembly for the dividing wall, and if needed the cross-braces 35 for the frame construction 33 can be inserted.

Figure 4:
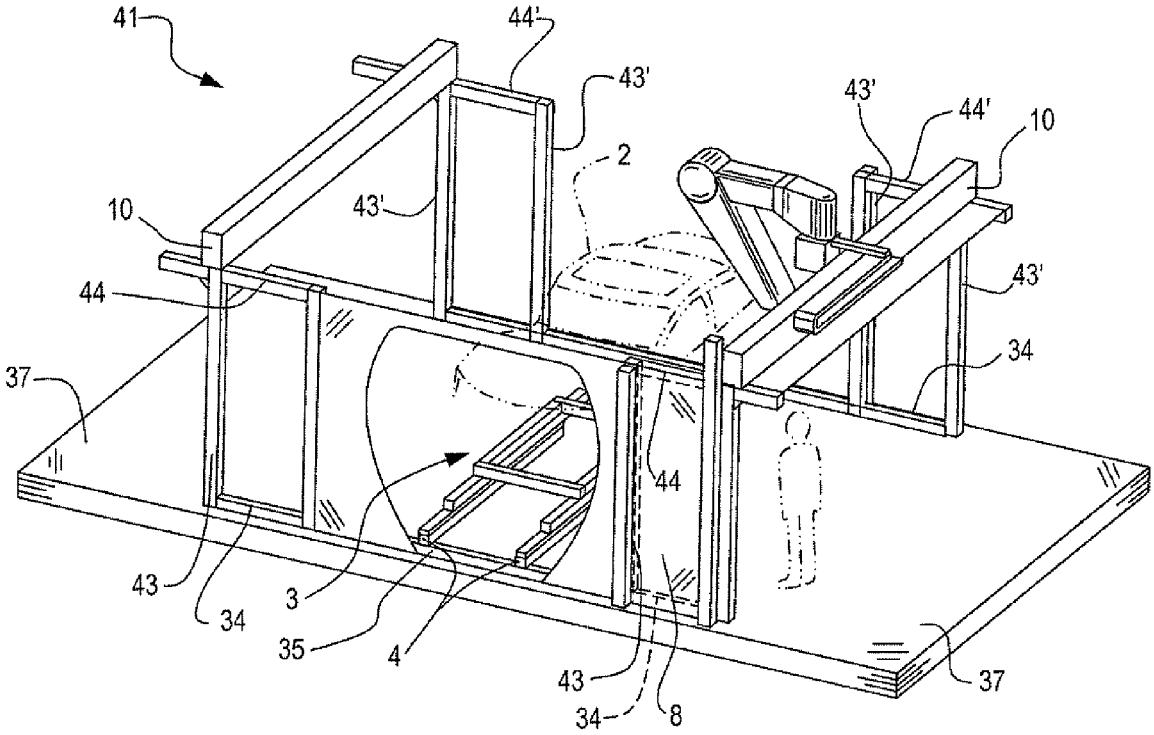
FIG. 4 shows a variation of the embodiment from FIG. 3.

The coating zone 41 shown in FIG. 4 is a variation of the embodiment from FIG. 3, differing essentially only in that the frames 43, which act as load-bearing structure for the guide rail arrays 10 for the robots and are identical in principle with the frame structure 33, do not extend on the side facing away from the conveyor 3 of the robot guide rails and the side walls, but, as shown in the drawing, are located on the side facing the conveyor. The guide rails 10, as shown in the drawing, lie on an extension of the upper transverse support members 44 of the frame 43 oriented horizontally outward. The dividing wall 48 is inserted to form a tight seal between the load-bearing structures of the robot guide rails, acting as a reinforcement. The frame structures 43 (or 33 in FIG. 3) can contain transparent or other wall elements.

The embodiments described can be modified in different respects, particularly with regard to the rail arrays. For example, it may be expedient to position transverse rails inside or outside the coating zone (or a control zone or repair zone in the case of the additional equipment mentioned) ahead of and/or behind the treatment area, for example, perpendicular (y-direction) to the rails running parallel to the direction (x-direction) of the conveyor of the application objects in the plane, or planes, of the x-rails. These transverse rails may also be located above the application objects and are preferably connected to the appropriate x-rail(s) on the same plane in such a way that the robots involved can switch from the x-rail to the transverse rail and conversely, and/or between the x-rails on opposite sides of the conveyor track, for example in a way that is well-known from conveyor technology.

Instead of the linear rail arrays described, another possible modification is to install guide rails with a path that is specifically horizontally circular or partially circular or perhaps ovoid curved, preferably symmetrical and preferably closed with reference to the conveyor track or a vertical axis. In this instance also, a rail array above the application objects, such as vehicle bodies, can be particularly advantageous.

Such modified rail arrays can also be expedient in installations in which substantial features of the invention described here, particularly regarding the slanting shape of the side walls or the special load-bearing structure and its supporting members have not been realized, although on the other hand they can be combined with each of the other features of the invention described. In particular, the x-y rail arrays with the switch-over potential for the robots and the rail arrays with a curved or circular path are suitable for suspended installation in a coating, control or repair zone. Suspended installation from a booth ceiling, for example or from a slanting side wall of a booth can be implemented, particularly in the way described in the application EP 06 1117 the complete content of which is incorporated in the disclosure of the present application.

The arrangement of additional equipment on guide rails can also be combined with each of the other features described in the present application, similarly without being restricted to the essential features of the invention mentioned since the arrangement has advantages independent thereof, for example, good utilization of space and reduction of construction costs in a coating installation and, when using common robots for different equipment, a reduction of costs for machinery and controls.

In general, the combination of each of the features described in this application with one or more of the other features described is possible without restriction to other features and advantageous, depending on the particular implementation.

The zones described can be located one behind the another in a conventional unilinear coating installation. They can also be located parallel to each other if the line of conveyance of the application objects splits off into several parallel branches in each of which at least one of the treatment zones is located as described in patent application DE 10 2006 022 335, the complete content of which is incorporated into the disclosure of the present application.

The robot guide rails in all embodiments of the invention with coating zones should preferably be designed and located in such a way that the rails and robots do not, or at least not substantially, affect the airflow in the booth. This is achieved by a slim shape and/or by positioning the rail outside, specifically above the painting area.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A coating zone, in a paint booth for vehicle bodies, comprising:

a conveyor configured to transport an application object through the coating zone, at least one guide rail running on opposite sides next to the conveyor and located above the conveyor, the at least one guide rail including a robot and configured to allow the robots to move in a guided manner along the conveyor, load-bearing structures on at least one side of the conveyor to support the at the least one guide rail, an upper ceiling through which feed air enters the coating zone, two side walls located on opposite sides of the conveyor which extend downward from the ceiling to a floor level, a first walk-in control area which is located on the outside facing away from the conveyor of at least one of the two side walls at floor level, and a second walk-in control area which is located on the outside of at least one of the two side walls in the proximity of the guide rail above the first walk-in control area and above the conveyor, wherein the side wall at the upper walk-in control area runs upward on a slant as a width of a interior of the coating zone progressively narrows;

wherein the side wall at the lower walk-in control area extends upward substantially perpendicular to floor level to a height above the application object.

2. The coating zone of claim 1, further comprising:

wherein the at least one load-bearing structures includes two load-bearing structures separated one from the other on at least one side of the conveyor to provide lateral support of the least one guide rail, and wherein the two load-bearing structures are located laterally next to a line of conveyance of the conveyor while leaving the line of conveyance open at the at least one side wall is braced by supporting members extending perpendicular to the line of conveyance in at least one location selected from a group consisting of floor level, below floor level, at the ceiling, and in the ceiling.

3. The coating zone of claim 2, wherein the load-bearing structures are located on both sides of the conveyor and are connected by at least one cross-brace where the cross-brace runs under the conveyor.

4. The coating zone of claim 3, wherein a supporting member is associated with the ceiling and the guide rail is carried by suspended vertical supports attached to the ceiling.

5. The coating zone of claim 1, wherein a dividing wall runs perpendicular to a line of conveyance of the conveyor and is located with respect to at least one of an entry side and an exit side of the coating zone and is attached to at least one of the load-bearing structures, and is configured and located as a support for the guide rails.

6. The coating zone of claim 1, wherein a dividing wall is located on at least one side of a line of conveyance of the conveyor running parallel to the line of conveyance.

7. The coating zone of claim 1, wherein two guide rails for robots are located one above the other on at least one side of the conveyor.

8. The coating zone of claim 1, wherein the load-bearing structure is located on a side of the at least one guide rail facing the conveyor.

9. The coating zone of claim 1, wherein the load-bearing structure is located on a side of the at least one guide rail facing away from the conveyor.

10. The coating zone of claim 6, wherein the dividing wall is at least partially transparent.

11. The coating zone of claim 6, wherein a cut-out is located in the dividing wall above a line of conveyance to transport the application object through on the line of conveyance.

12. The coating zone of claim 6, wherein a door is located in the dividing wall.

13. The coating zone of claim 1, wherein the at least one guide rail is located above the application object.

14. The coating zone of claim 1, wherein individual coating zones are arranged one after another along a line of conveyance.

15. The coating installation of claim 14, wherein the individual coating zones have different air speeds.

16. The coating zone of claim 1, wherein the coating zone is configured to provide an airflow downward through the coating zone, the airflow directed along the side walls.

17. The coating zone of claim 1, wherein the side wall at the upper walk-in control area runs upward on a constant slant such that the width of the interior of the coating zone progressively narrows at a constant rate.

* * * * *